United States Patent [19]

Mosier

[11] Patent Number: 4,952,921

[45] Date of Patent: Aug. 28, 1990

[54] GRAPHIC DOT FLARE APPARATUS

[75] Inventor: Donald E. Mosier, Cedar Rapids, Iowa

[73] Assignee: Rockwell International Corporation, El Segundo, Calif.

[21] Appl. No.: 204,469

[22] Filed: Jun. 9, 1988

[51] Int. Cl.[5] ..... G09G 5/10

[52] U.S. Cl. ..... 340/728; 358/443

[58] Field of Search ..... 340/720, 723, 728, 731, 340/750; 358/138, 140, 443; 382/41, 47, 56

[56] References Cited

U.S. PATENT DOCUMENTS

| | | | |
|---|---|---|---|
| 4,119,956 | 10/1978 | Murray | 315/383 |
| 4,127,850 | 11/1978 | Vallins | 340/980 |
| 4,215,414 | 7/1980 | Huelsman | 340/728 |
| 4,262,290 | 4/1981 | Vallins | 340/728 |
| 4,297,691 | 10/1981 | Kodama et al. | 340/723 |
| 4,528,693 | 7/1985 | Pearson et al. | 340/731 |
| 4,584,572 | 4/1986 | Lambert, III | 340/728 |
| 4,612,540 | 9/1986 | Pratt | 340/728 |
| 4,642,623 | 2/1987 | Dureux | 340/728 |
| 4,649,378 | 3/1987 | Johnson et al. | 340/728 |
| 4,670,792 | 6/1987 | Dureigne et al. | 358/280 |
| 4,672,369 | 6/1987 | Preiss et al. | 340/728 |
| 4,725,892 | 2/1988 | Suzuki et al. | 340/728 |
| 4,780,711 | 10/1988 | Doumas | 340/728 |
| 4,808,984 | 2/1989 | Trueblood et al. | 340/728 |
| 4,829,587 | 5/1989 | Glazer et al. | 340/728 |
| 4,837,562 | 6/1989 | Nishiura et al. | 340/728 |

*Primary Examiner*—Alvin Oberley

*Assistant Examiner*—Richard Hjerpe

*Attorney, Agent, or Firm*—Gregory C. Williams; M. Lee Murrah; H. Fredrick Hamann

[57] ABSTRACT

A starburst processor for providing dot flare and for use with a system having a means for generating graphic data for a set of logical pixels to be displayed on a display having a set of physical pixels. The starburst processor receives a set of commanded intensity values which has a one-to-one correspondence with the set of logical pixels. The system provides the set of commanded intensity values for the graphic data to be displayed. The starburst processor provides a set of actual intensity values which have a one-to-one correspondence with the set of physical pixels, each selected actual intensity value being a function of commanded intensity values for a predetermined neighborhood of logical pixels including a selected logical pixel corresponding to the selected actual intensity value. The neighborhood is a set of logical pixels which correspond to the set of commanded intensity values. For example, the neighborhood can include a selected logical pixel and all logical pixels adjacent to the selected logical pixel. Other neighborhoods can be defined depending upon the type of dot flare which is desired. From the neighborhood of commanded intensity values the starburst processor provides a selected actual intensity value for a selected physical pixel in the display which corresponds to a selected logical pixel. This actual intensity value is assigned a value from a predetermined plurality of different values.

7 Claims, 3 Drawing Sheets

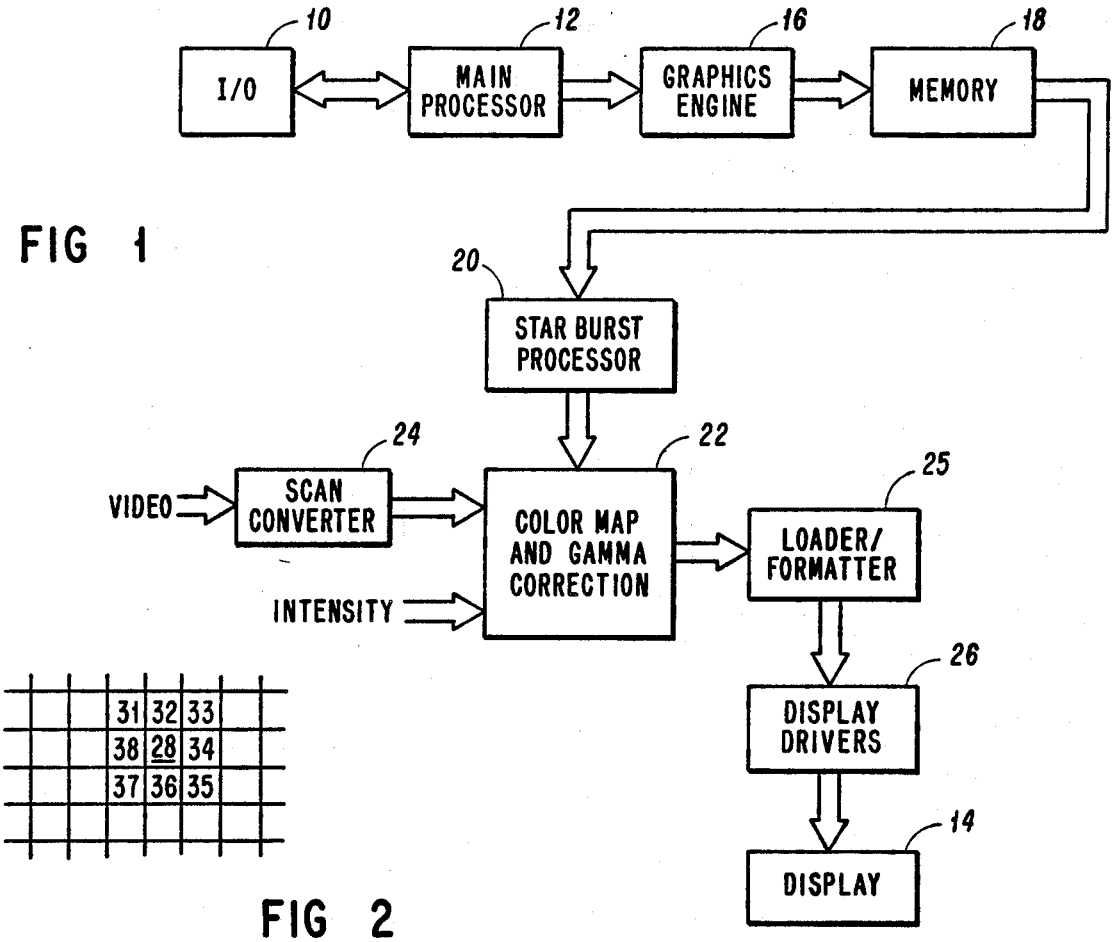
FIG 1
FIG 2
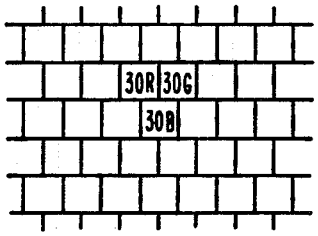
FIG 3
FIG 4
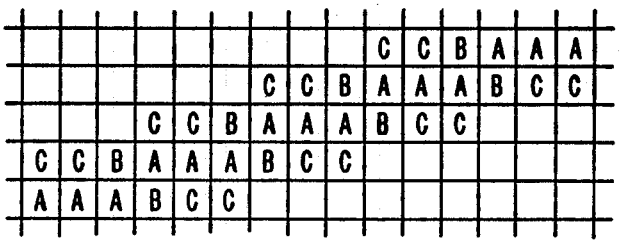

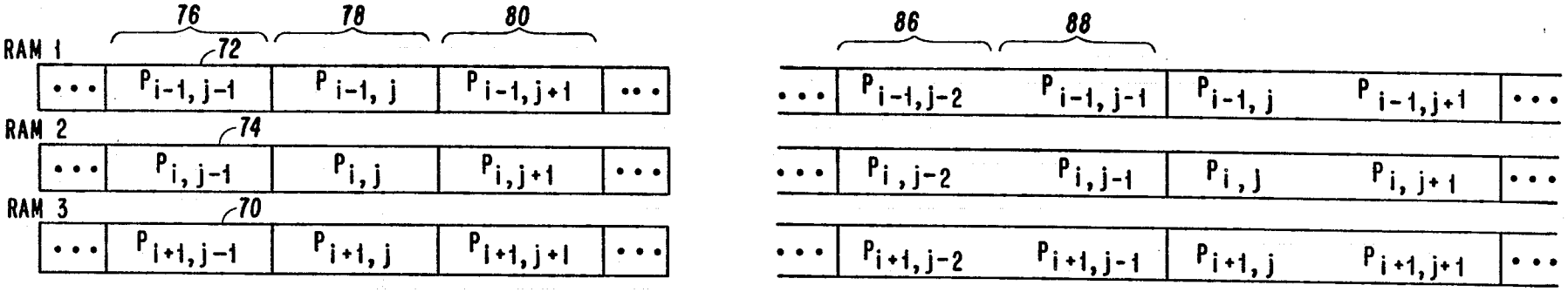
FIG 8
FIG 10
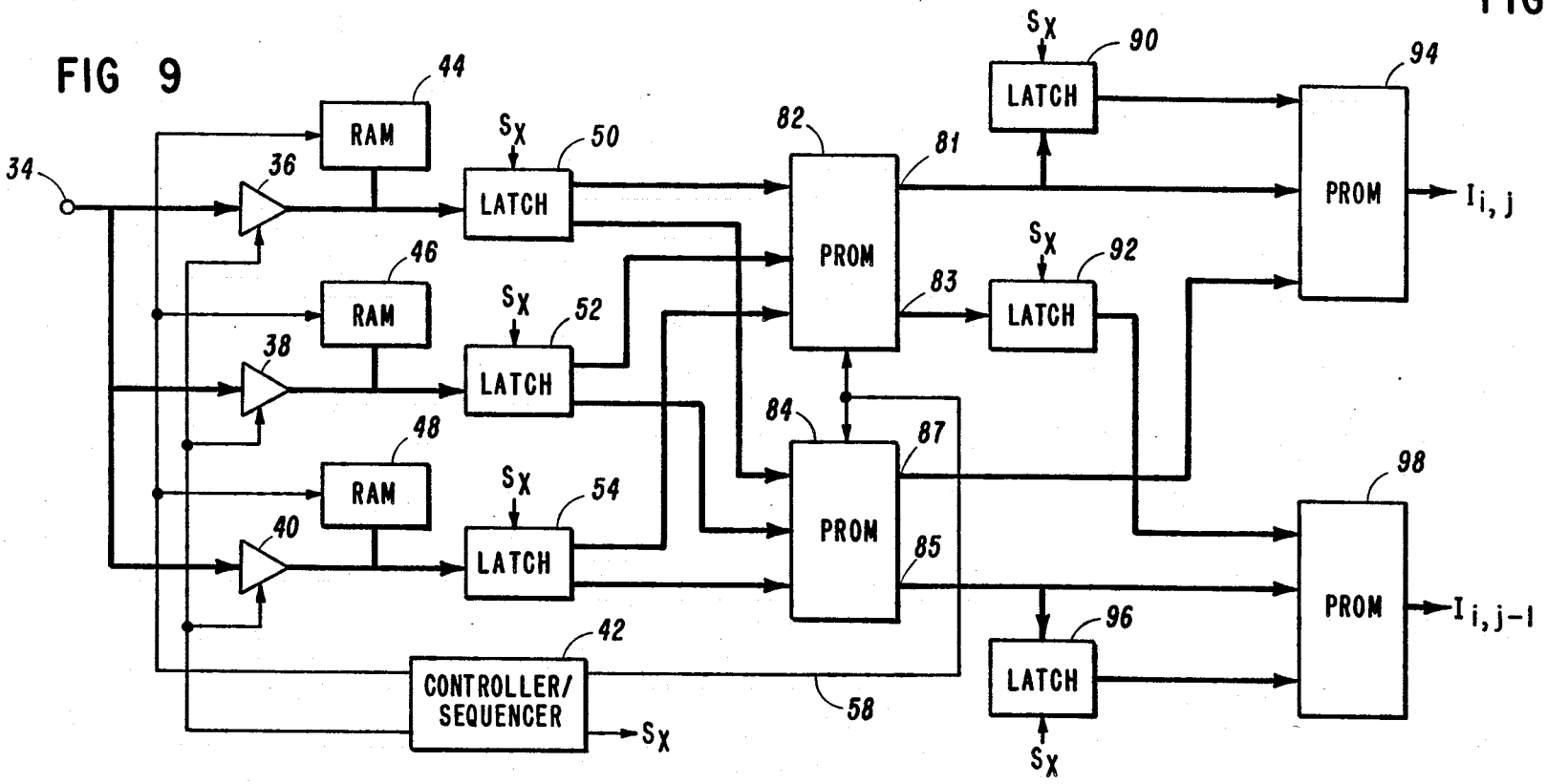
FIG 9

GRAPHIC DOT FLARE APPARATUS

BACKGROUND OF THE INVENTION

The present invention relates in general to graphic dot flare devices and, in particular, to a starburst processor for providing graphic dot flare for a digitized video display.

Typical video displays in which the display is changeable over a period of time have picture pixels which are arranged in rows and columns. Such displays can utilize a cathode ray tube, a light-emitting diode grid or liquid crystal elements. Such displays can be monochromatic or produce color by using groups of three pixels having red, green and blue colors as is well known in the art. A pixel can be defined as the smallest area of a digital display screen all of which has the same color wherein the term "color" means color value, hue or shade. The term implies that the color of an individual pixel may and can have a color different from that of any pixel adjacent to it in the display. Furthermore, the intensity of each physical pixel in the display can be varied. For a color graphics display, a group of three physical pixels such as adjacent red, green and blue pixels is termed a logical pixel to which a single intensity value is assigned.

In digital displays wherein the resolution of the display is determined by the number of horizontal and vertical pixels, certain graphic designs, such as a diagonal line, will appear to be "choppy" rather than smooth due to the digitized matrix pixel arrangement. It is known in the prior art that by causing adjacent pixels next to a selected pixel to have intensities reduced from the intensity of the selected pixel, an optical appearance of a smoother diagonal line can be created. This corresponds to the effect of dot flare, for example, in cathode ray tubes.

Although a number of different techniques for providing dot flare in graphic displays such as light-emitting diode or iquid crystal displays are known in the prior art, the present invention provides an improved dot flare apparatus for use in a digitized display.

SUMMARY OF THE INVENTION

An object of the present invention is to provide an improved dot flare apparatus for use in a digitized display. An advantage of the present invention is that the circuitry utilized for implementing the dot flare feature is effected with a minimum of components which are standard in the electronics art. It is an advantage of the present invention in that a set of actual intensity values for the pixels in the digitized display are calculated from a set of commanded intensity values which is determined by the video system in which the present invention is utilized.

The present invention provides a starburst processor for use with a system having a means for generating graphic data for a set of logical pixels to be displayed on a display having a set of physical pixels. The starburst processor has a means for providing a set of commanded intensity values which has a one-to-one correspondence with the set of logical pixels. The system provides the set of commanded intensity values for the graphic data to be displayed. The starburst processor also has a means for providing a set of actual intensity values which have a one-to-one correspondence with the set of physical pixels, each selected actual intensity value being a function of commanded intensity values for a predetermined neighborhood of logical pixels containing a selected logical pixel corresponding to the selected actual intensity value. The neighborhood can be thought of as a set of pixels which correspond to the set of intensity values. For example, the neighborhood can include a selected logical pixel and all logical pixels adjacent to the selected logical pixel. Other neighborhoods can be defined depending upon the type of dot flare which is desired. From the neighborhood or commanded intensity values the starburst processor provides a selected actual intensity value for a selected physical pixel in the display which corresponds to a selected logical pixel. This actual intensity value can be assigned a value from a predetermined plurality of different values in a look-up table or derived from a mathematical formula.

An apparatus for implementing the starburst processor has an input connected to a memory in which is stored the commanded intensity values which correspond in a one-to-one relationship to the logical pixels. These commanded intensity values are effectively scanned on a line-by-line basis and temporarily stored in three random access memories, while concurrently a slice of three pixels in a vertical row are processed to form an intermediate value. Two more subsequent vertical slices are then processed resulting in a total of three intermediate values. These three intermediate values are then finally processed into a final actual intensity value for one selected physical pixel. By continuing this operation, all physical pixels will have an actual intensity value calculated for them which is a function of the neighborhood of logical pixels, that is, the neighborhood of commanded intensity values.

Thus, it will be appreciated for the example of a diagonal line which actually appears as a stair-step type line in the logical pixels, the resulting diagonal line for the physical pixels will have the pixels directly on the line having the highest intensity with adjacent pixels having reduced intensity, thereby creating a dot flare effect. As a result, a video system using the novel starburst processor will produce optically superior graphics than prior art systems.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

FIG. 1 is a general block diagram of a video system utilizing the present invention;

FIG. 2 schematically depicts the digitized display screen having elementary pixels in a rectilinear configuration;

FIG. 3 depicts a digitized display screen having the elemental pixels in a staggered configuration;

FIG. 4 schematically depicts a diagonal line displayed on a digitized display having the dot flare feature;

FIG. 8 schematically depicts the temporary storage of commanded intensity values corresponding to logical pixels in random access memories of the FIG. 7 circuit;

FIG. 9 is a more specific block diagram of an alternative embodiment for the starburst processor shown in FIG. 1; and FIG. 10 is a schematic representation of the temporary storage of commanded intensity values of logical pixels in random access memories in the FIG. 9 embodiment.

DESCRIPTION OF THE PREFERRED EMBODIMENT

Figure 6:
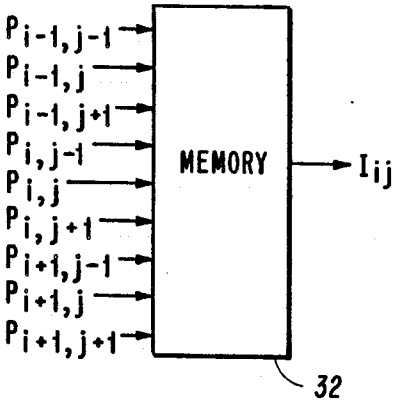
FIG. 6 schematically depicts a functional transformation of the nine pixels depicted in FIG. 5 into one selected actual intensity value for a selected physical pixel.

The present invention has general applicability but is most advantageously utilized in a video display system of the type shown generally in FIG. 1. The present invention is especially applicable to digital displays which have a plurality of defined pixels of light-emitting diodes or liquid crystals.

As shown in FIG. 1, and as is known in the prior art, an input/output unit 10 interfaces with a main processor 12 which determines the information to be displayed on a digital display. The input/output unit 10 may interface with any one of a number of applications such as the operating characteristics of an aircraft. A typical digital display can be a liquid crystal display having a matrix of pixels measuring 512 in a horizontal direction by 512 in a vertical direction. Obviously, other size displays could be utilized. In any case, the main processor 12 contains data to be shown on a display 14.

A graphics engine 16 which is connected to the main processor 12, receives the data for the text or graphics to be shown on the display 14 and generates among other parameters at least a value of intensity for each of the pixels in the display 14. These are referred to as commanded intensity values and are stored in a memory 18 connected to the graphics engine 16. Since the graphics engine 16 does not provide dot flare, the commanded intensity values are for "logical" pixels. Therefore, the commanded intensity values stored in the memory 18 have a one-to-one one correspondence withthe logical pixels. In the case of a monochrome display, each pixel, that is each physical pixel in the display 14, has a one-to-one correspondence with the commanded intensity value of the logical pixels which are calculated by the graphics engine 16. For a color graphics display, three color elements, a red, green and blue, form one logical pixel for emitting the particular color desired. Thus, in the case of a color graphics display, the commanded intensity values stored in the memory 18 refer to the logical pixels, each of which is a triad of color elements.

As will be explained later in more detail, the starburst processor 20 receives the set of commanded intensity values from the memory 18 and outputs a new set of actual intensity values to a color map and gamma correction circuit 22. The starburst processor 20 thus provides a new set of intensities which correspond in a one-to-one relationship with the physical pixels of the display 14. This new set of actual intensity values outputted by the starburst processor 20, incorporates the dot flare feature into the graphics data to be displayed on the display 14.

As is known in the art, video information is fed to a scan converter 24 which in turn provides information to the color map and gamma correction circuit 22. Also, an intensity reference level may be provided to the color map and gamma correction circuit 22 for gamma correction. This color map and gamma correction circuit 22 combines the information from the starburst processor 20 from the scan converter 24 and the intensity reference level to provide the correct signals for activating the physical pixels in the display 14. The output of the color map and gamma correction circuit 22 is connected to an input of a loader/formatter 25 for properly formatting the data which then outputs the formatted signals to display drivers 26 which, in turn, provide the actual voltage levels for driving the physical pixels in the display 14.

The display 14 may have a rectilinear pattern of pixels as shown in FIG. 2 or a staggered pattern of pixels as shown in FIG. 3. A selected pixel 28 as shown in FIG. 2 will have associated with it a selected commanded intensity value as determined by the graphics engine 16 and stored in the memory 18. In the case of a monochromatic display, the logical pixel related to the commanded intensity value stored in a memory 18 corresponds on a one-to-one basis with the physical pixel 28 shown in FIG. 2. In the case of a color graphics display, a triad of colored elements are used as is well known in the prior art (see FIG. 3). For example, red element 30R blue element 30B and green element 30G, form one logical pixel which has a commanded intensity value. For the purpose of this description the corresponding physical pixel is also a triad of red, blue and green elements. Thus the one-to-one correspondence also exists between the logical pixels and the physical pixels for a color graphics display.

As an example of the operation of the present invention, let it be assumed that the graphics engine 16 has determined that the logical pixel corresponding to the physical pixel 28 shown in FIG. 2 is to be activated with a predetermined maximum intensity, while its surrounding adjacent logical pixels corresponding to physical pixels 31 through 38 are not to be illuminated. Therefore, the commanded intensity values for these nine pixels would be a maximum value for pixel 28 and zero values for pixels 31 through 38. This data is stored in the memory 18. The physical pixel 28 in the display 14 will have an actual intensity value which is a function of the commanded intensity values of the nine logical pixels, that is, adjacent pixels 31 through 38 and the selected pixel 28 of the logical pixels. Especially for a monochromatic display, it can be seen that the logical pixels correspond directly in a one-to-one relationship with the physical pixels in the display 14. In general, the starburst processor 20 will determine intensity levels for each of these nine physical pixels such that, for example, the selected physical pixel 28 will have a maximum intensity and the surrounding adjacent physical pixels 31 through 38 will have lesser intensities as determined by the mathematical function which governs the starburst processor 20. Note that this assumes that other logical pixels surrounding this group of nine logical pixels also would have zero commanded intensity values.

FIG. 4 depicts an example of a display 14 of a video system using a starburst processor 20. In the example, a diagonal line is to be depicted on the display 14 by the pixels identified by the letter "A". Since the pixels are arranged in a rectilinear fashion, the diagonal line can only be represented by a stair-step type display. In order to provide dot flare, pixels designated by the letter "B" could be displayed at an intensity of for example, $\frac{1}{2}$ that of the "A" pixels. Pixels designated by the letter "C" could be displayed with an intensity of $\frac{1}{3}$ that of the "A" pixels. Thus, the commanded intensity values stored in the memory 18 would have values only for those pixels designated by the letter "A". After processing by the starburst processor 20, all physical pixels designated by "A", "B" and "C" would have values of maximum, $\frac{1}{2}$ and $\frac{1}{3}$, respectively. Thus, the starburst processor 20 has provided a dot flare feature which makes the diagonal line appear to be more even.

Figure 5:
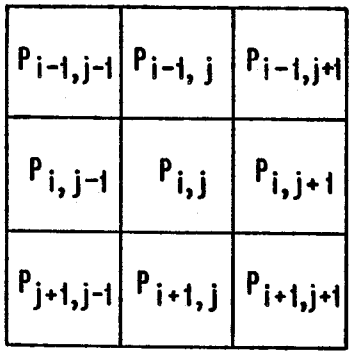
FIG. 5 schematically depicts a neighborhood of nine pixels.

The notation for the calculations of a selected pixel, such as $P_{i,j}$ as shown in FIG. 5 involves the surrounding adjacent pixels also as shown in FIG. 5. This notation will be used to describe the operation of the present invention. It is to be understood that each of the nine pixels shown in FIG. 5 has a corresponding commanded intensity value stored in the memory 18 and that each of these nine commanded intensity values are utilized by the starburst processor 20 to calculate an actual intensity value for the center selected pixel $P_{i,j}$. As was previously stated, a typical digital display has 512 horizontal pixels by 512 vertical pixels. As shown in FIG. 6, every commanded intensity value for each of the logical pixels developed by the grapics engine 16 could be stored in a memory 32. After which either a look-up table or a calculation could be utilized to calculate each actual intensity value for every physical pixel in the display 14. However, this has a severe drawback in that the memory 32 would have to be so large as to be prohibitively expensive and the system would be prohibitively slow in doing the calculations. The present invention provides a novel approach to calculating and providing the actual intensity values for each of the physical pixels in the display 14 from the commanded value intensity of the logical pixels stored in the memory 18. This is implemented by way of the hardware which is shown in an embodiment in FIG. 7.

Figure 7:
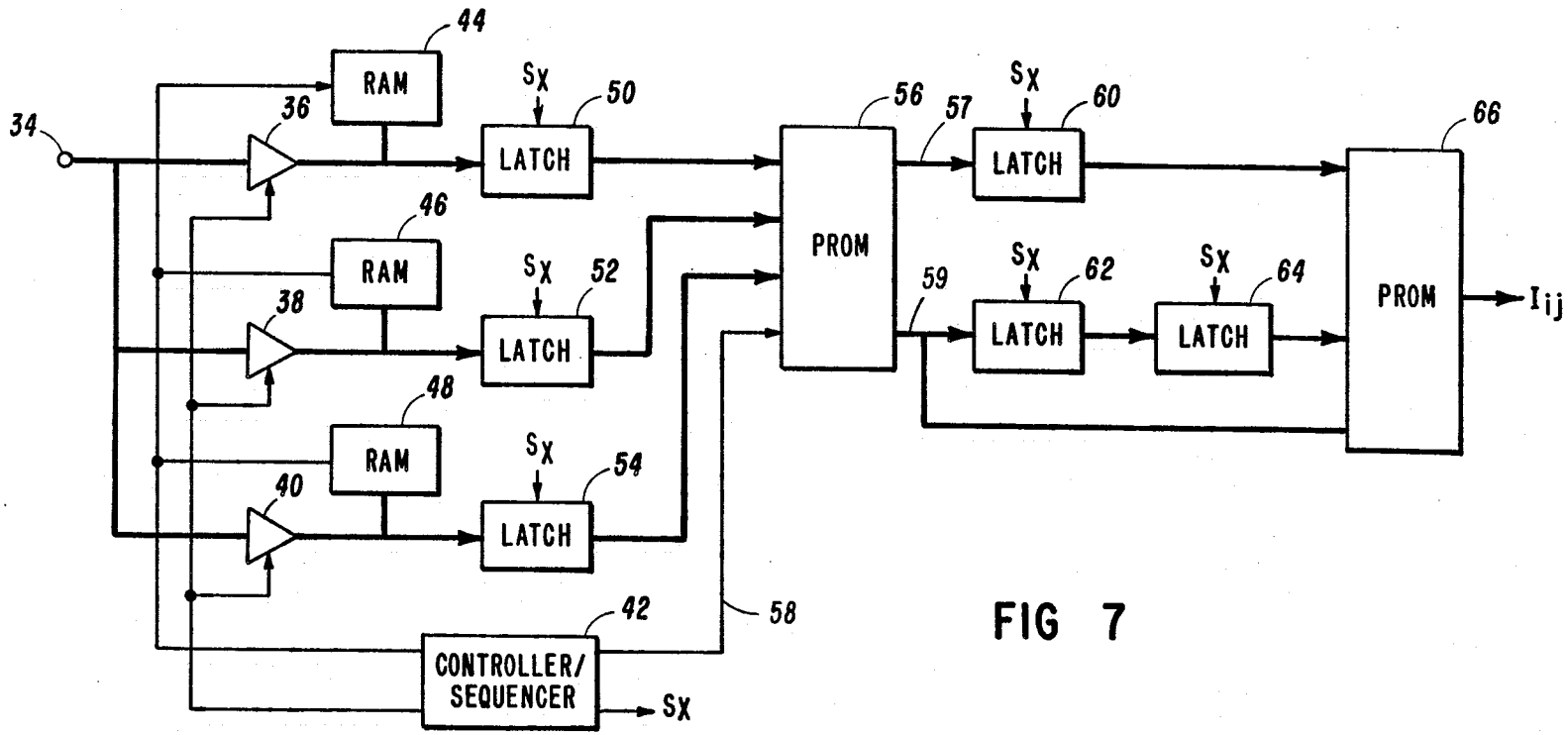
FIG. 7 is a more specific block diagram of a starburst processor as shown in FIG. 1.

As shown in FIG. 7, an input terminal 34 of the starburst processor is connected to the output of the memory 18. The terminal 34 is connected to the inputs of three tri-state buffers 36, 38 and 40, which are controlled by a controller/sequencer 42. The controller/sequencer 42 also controls the read/write functions of random access memories 44, 46 and 48 which have their inputs connected to the outputs of the tri-state buffers 36, 38 and 40, respectively. Latches 50, 52 and 54 also have their inputs connected to the outputs of the tri-state buffers 36, 38 and 40, respectively. A first programmable read only memory 56 has three inputs connected to the outputs of latches 50, 52 and 54, respectively. The controller/sequencer 42 also provides a signal on line 58 to the first programmable read only memory 56 for identifying a "center select". The controller/sequencer 42 further provides a clock output $S_x$ which is utilized by all the latches in the system as will be explained as follows. Center and noncenter outputs 57 and 59 of the first programmable read only memory 56 are connected to inputs of latches 60 and 62, respectively. The output of latch 62 is connected to an input of latch 64. The outputs of latch 60, latch 64 and the noncenter output 59 of the first programmable read only memory 56 are connected to inputs of a second programmable read only memory 66. The output of the second programmable read only memory 66 is the actual intensity value of $I_{i,j}$ of the selected physical pixel corresponding to the center logical pixel $P_{i,j}$. During operation of the starburst processor shown in FIG. 7, the random access memory 44, for example, can contain a first line of commanded intensity values from the memory 18, the second random access memory 46 can contain a second line of commanded intensity values and the third random access memory 48 can contain a third line of commanded intensity values. Such storage is depicted in FIG. 8. In this example, and at a particular point, let it be assumed that line RAM1 is contained in random access memory 44, line RAM2 is contained in random access memory 46 and element 70 of line RAM3 is at this time, being inputted to the random access memory 48 through the tri-state buffer 40 which concurrently is received by latch 54. Simultaneously, the controller/sequencer 42 will have transferred element 72 from line RAM1 into latch 50 and element 74 in line RAM2 into latch 52. On the next clock cycle, this vertical slice 76 of elements 70, 72 and 74 will be inputted to the first programmable read only memory 56 which from a look-up table and depending upon the commanded intensity values stored in the vertical slice of elements 70, 72 and 74 assigns an intermediate value which then on the next clock cycle is sent to latch 62 and the second programmable read only memory 66 on the noncenter output 59 of the first programmable read only memory 56. When the next intermediate value is outputted on the center output 57 to latch 60 for the next vertical slice represented by 78 in FIG. 8, the previous intermediate value is transferred to latch 64 from latch 62. On the following clock cycle, an intermediate value is determined for vertical slice 80 and outputted on noncenter output 59. As the latches 60, 62 and 64 are clocked, it can be seen that the programmable read only memory 66 receives the intermediate value for the first vertical slice from the latch 64 at the same time as receiving the intermediate value for the second vertical slice from the latch 60 and the intermediate value for the third vertical slice 80 from the first programmable read only memory 56. The second programmable read only memory 66 then can utilize a look-up table, for example, to output the actual intensity value $I_{i,j}$ from the three intermediate values representing the vertical slices 76, 78 and 80. Thus, the actual intensity value $I_{i,j}$ corresponds in a one-to-one relationship to the center commanded intensity value of the selected logical pixel $P_{i,j}$.

As this circuit operates in a continuous fashion, then the line RAM3 will eventually fill the random access memory 48 while the starburst processor 20 is calculating all of the $I_{i,j}$ for the line RAM2. The controller/sequencer 42 via line 58 has identified to the first programmable read only memory 56 that line RAM2, that is, that random access memory 46 contains the center selected pixels. This causes the intermediate value for the vertical slice 78 containing selected center logical pixel $P_{i,j}$ to be outputted on center output 57 and the other intermediate values to be outputted on noncenter output 59. When this process has been completed, the starburst processor will begin inputting the line below the line RAM3 into the random access memory 44 since the information from line RAM1 is no longer needed. Thus, the center line containing the center pixels is now contained in line RAM3 of random access memory 48. The controller/sequencer 42 provides this information on line 58 to the first programmable read only memory 56. As each element in the line is inputted to random access memory 44, the processor simultaneously calculates each of the actual intensity values for the "center"

pixels in line RAM3. This process continues until all of the pixels to be displayed have actual intensity values assigned to them.

For this embodiment, only four bits of information are needed for each of the elements shown in FIG. 8, such as element 70. Four bits of information are sufficient to establish an intensity level for displaying a particular pixel. Since most random access memories on the market today are eight bit per byte memories, an alternative embodiment shown in FIG. 9 can be used to more efficiently utilize memory space and thus, have reduced costs. In this embodiment, two commanded intensity values are stored in one byte of memory of the random access memories. This is depicted in FIG. 10 which essentially corresponds to the process as depicted in FIG. 8. The difference here being that the circuitry shown in FIG. 9 must address and reference the four least significant bits and the four most significant bits in each byte of memory of the random access memories.

Differing from the embodiment of FIG. 7, the FIG. 9 embodiment has two programmable read only memories 82 and 84 each of which receive the outputs of the latches 50 52 and 54. In this embodiment, programmable read only memory 82 receives the four least significant bits for the vertical slice of pixels indicated as 86 in FIG. 10 and the programmable read only memory 84 receives the four most significant bits illustrated by vertical slice 88. Similar to the process described above, intermediate values are calculated for each vertical slice. The noncenter output 81 of programmable read only memory 82 is connected to the input of latch 90 and to an input of a second programmable read only memory 94. The center output 83 of programmable read only memory 82 is connected to an input of latch 92. The noncenter output 85 of programmable read only memory 84 is connected to the input of latch 96 and to an input of programmable read only memory 98. The center output 87 of the programmable read only memory 84 is connected to an input of programmable read only memory 94. The output of latch 92 is also connected to an input of programmable read only memory 98. Using these intermediate values, the programmable read only memories 94 and 98 using look-up tables or other calculations output the actual intensity value of the pixel designated $I_{i,j}$ and the pixel designated $I_{i,j-1}$, respectively. As described above, the starburst processor 20 scans the memory 18 and sequentially calculates and assigns actual intensity values for each of the physical pixels in the display 14.

The invention is not limited to the particular details of the apparatus and method depicted and other modifications and applications are contemplated. Certain other changes may be made in the above described apparatus and method without departing from the true spirit and scope of the invention herein involved. It is intended, therefore, that the subject matter in the above depiction shall be interpreted as illustrative and not in a limiting sense.

What is claimed is:

1. A starburst processor for use with a system having means for generating graphic data referenced to a set of logical pixels to be displayed on a display having a set of physical pixels, said starburst processor comprising:

means for providing a set of commanded intensity values having a one-to-one correspondence with the set of logical pixels, said set of commanded intensity values and said corresponding set of logical pixels arranged grid like and stored in a first memory having an output port;

first, second and third means for selectively accessing data representative of commanded intensity values, each having inputs connected to said output port of said first memory;

first, second and third means for storing said data connected to an output of said first, second and third means for selectively accessing said data, respectively;

first, second and third means for latching said data each having an input connected to said output of said first, second and third means for selectively accessing said data, respectively;

means for processing said data connected to outputs of said first, second and third means for latching, including:

first PROM means having a center output and a noncenter output adapted for calculating intermediate data corresponding to weighted center and noncenter intermediate intensity values, fourth means for latching selected intermediate data having an input connected to said noncenter output of said first PROM means, fifth means for latching selected intermediate data having an input connected to an output of said fourth means for latching, sixth means for latching selected intermediate data having an input connected to said center output of said first PROM means, and second PROM means for calculating having first, second and third inputs connected, respectively, to said noncenter output of said first means for calculating, to an output of said fifth means for latching and to an output of said sixth means for latching adapted for calculating data representing actual intensity values; and means for controlling timing and data selection connected to said first, second and third means for selectively accessing, to said first, second and third means for storing, to said said first, second and third means for latching, and to said means for processing;

whereby said means for processing outputs a set of actual intensity values having a one-to-one correspondence with the set of physical pixels, each actual intensity value being a function of a predetermined neighborhood of commanded intensity values.

2. The starburst processor according to claim 1, wherein said system further has a display having a set of physical pixels in a one-to-one correspondence with said set of logical pixels and wherein said system further has means for activating said physical pixels of said display from said set of actual intensity values.

3. The starburst processor according to claim 1, wherein said means for controlling causes said first means for calculating to output on said center output an intermediate value for a vertical slice of commanded intensity values stored in said first, second and third means for storing which contains a selected commanded intensity value corresponding to a selected logical pixel and to output on said connecter output two intermediate values for two vertical slices of commanded intensity values adjacent to said vertical slice containing said selected commanded intensity value.

4. The starburst processor according to claim 1 wherein said first and second PROM means include look-up tables which contain a plurality of values for determing said selected actual intensity value for said neighborhood of commanded intensity values.

5. A starburst processor for use with a system having means for generating graphic data reference to a set of logical pixels to be displayed on a display having a set of physical pixels, said starburst processor comprising:

means for providing a set of commanded intensity values having a one-to-one correspondence with the set of logical pixels, said set of commanded intensity values and said corresponding set of logical pixels arranged grid like and stored in a first memory having an output port;

first, second and third means for selectively accessing data representative of commanded intensity values, each having inputs connected to said output port of said first memory;

first, second and third means for storing said data connected to an output of said first, second and third means for selectively accessing said data, respectively, each adapted for storing two adjacent horizontal command intensity values in each of its addressable memory locations;

first, second and third means for latching said data each having an input connected to said output of said first, second and third means for selectively accessing said data, respectively, each adapted for providing a least significant bits output and a most significant bits output;

first means for processing connected to outputs of said first, second and third means for latching and including a first means for calculating having center and non-center outputs and inputs connected to said least significant bits output of said first, second and third means for latching and a second means for calculating having center and non-center outputs and inputs connected to said most significant bits outputs of first, second and third means for latching;

fourth, fifth and sixth means for latching having inputs connected to the center and non-center outputs of said first means for calculating, and said non-center output of said second means for calculating, respectively;

means for controlling timing and data selection connected to said first, second and third means for selectively accessing data, to said first, second and third means for storing data, to said first, second, third, fourth, fifth and sixth means for latching, and to said first means for processing; and second means for processing connected to selected outputs of said first means for processing and said fourth, fifth and sixth means for latching, and including third means calculating connected the center outputs of said first and second means for calculating and the output of said fourth means for latching and fourth means for calculating connected to the non-center output of said second means for calculating and the outputs of said fifth and sixth means for latching, said third and fourth means for calculating outputting a selected actual intensity value and a horizontally previous actual intensity value which are functions of predetermined neighborhoods of commanded intensity values.

6. The starburst processor according to claim 5, wherein said means for controlling is connected to said first and second means for calculating causing said first and second means for calculating to output on said center outputs thereof intermediate values of adjacent vertical slices of commanded intensity values stored in said said first, second and third means for storing.

7. The starburst processor according to claim 5, wherein said first and second means for calculating are programmable read only memories containing look-up tables which contain a plurality of values for determining said selected actual intensity value from said neighborhood of commanded intensity values.

* * * * *